US006926562B1

(12) United States Patent
Wu

(10) Patent No.: US 6,926,562 B1
(45) Date of Patent: Aug. 9, 2005

(54) CABLE END CONNECTOR ASSEMBLY WITH IMPROVED SPACER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/775,524

(22) Filed: Feb. 9, 2004

(51) Int. Cl.[7] ..... H01R 24/00
(52) U.S. Cl. ..... 439/660; 439/497; 439/579
(58) Field of Search ..... 439/660, 604, 439/606, 701, 494, 497, 499, 579

(56) References Cited

U.S. PATENT DOCUMENTS 4,062,611 A * 12/1977 Carlsson et al. ..... 439/65
5,506,379 A * 4/1996 McLean et al. ..... 200/558
6,039,611 A * 3/2000 Yang ..... 439/701
6,129,581 A * 10/2000 Lee ..... 439/497
6,129,594 A * 10/2000 Lai ..... 739/701
6,196,886 B1 * 3/2001 Sato ..... 439/885
6,443,773 B1 * 9/2002 Korsunsky et al. ..... 439/660
6,508,676 B1 * 1/2003 Xu ..... 439/660
6,623,299 B1 * 9/2003 Liu ..... 439/604
2003/0128975 A1 * 7/2003 Shevick ..... 396/428
2003/0129875 A1 7/2003 Ho
2004/0097132 A1 * 5/2004 Cheng ..... 439/606

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A cable end connector assembly (1) includes a housing (2), a number of contact units (3), a spacer (4), a number of wires (5), and a cover (6). The housing includes a pair of keys (28) in a rear wall thereof. Each contact unit comprises three mating portions (32) and a U-shaped tail portion (33) opposite to the mating portion. The spacer comprises a number of through holes (400) extending therethrough, a supporting portion (42) supporting the U-shaped tail portions, and a pair of keyways (410). The supporting portion defines a number of grooves (420) in a top surface thereof. Each wire comprises a conductive core (60) received in and soldered with the tail portion. The cover is over-molded with a rear end of the housing and front ends of the wires.

14 Claims, 9 Drawing Sheets

CABLE END CONNECTOR ASSEMBLY WITH IMPROVED SPACER

BACKGROUND OF THE INVENTION

1. Field of the Invention

The present invention generally relates to a cable end connector assembly, and more particularly to a Serial Advanced Technology Attachment (Serial ATA) cable end connector assembly with an improved spacer for providing good electric transmission performances.

2. Description of Related Art

There exists in the art an electrical connector known as a Serial ATA connector, which is generally used for disk drives and storage peripherals connecting with a mother board. Generally, a Serial ATA cable end connector assembly comprises a housing with a plurality of terminals therein and a cable having a plurality of wires. Tail ends of the terminals terminate the wires of the cable. For positioning the terminals, the Serial ATA cable end connector assembly usually further includes a spacer attached to the housing.

U.S. Pat. No. 6,623,299 B1 discloses such a Serial ATA cable end connector assembly having a dielectric housing, a plurality of contacts, a spacer and a cable having a plurality of conductive cores. Each contact comprises a retention portion, a mating portion extending forwardly from the retention portion and a tail portion extending rearwardly from the retention portion. The spacer has a plurality of positioning holes therein and a plurality of tubers in upper and lower edges. After the contacts are positioned in the housing, the spacer is attached to a rear end of the housing with the tubers engaging with an inner surface of the housing. The tail portions of the contacts extend through the positioning holes of the spacer and are exposed beyond a rear side of the spacer for being soldered with corresponding conductive cores of the cable. However, because each tail portion of the contact projects outside the rear side of the spacer in a suspended manner, the operation to solder the tail portions and the cable is performed in such a situation that the tail portions and the cable are not supported. Thus, both the tail portions and the cable are easily moved so that the quality of the soldering connection will be adversely affected. Therefore, it is necessary to provide a spacer having a supporting portion for supporting the tail portions of the contacts to overcome the above-mentioned disadvantages.

U.S. Patent Pub. No. 2003/0129875 A1 discloses a cable end connector assembly comprising an electrical connector, a cable solderable to the electrical connector and a protective sleeve over-molded with a rear end of the electrical connector and a front end of the cable. The electrical connector comprises an insulative housing, a plurality of conductive terminals each having a connecting end, and a base. The housing has a connecting side and a pair of protruding flanges extending outwardly from the connecting side. The base has a first side that can abut against the connecting side, and defines a plurality of downwardly tapering trapezoid-shaped grooves in a top surface thereof and a stop block proximate to the first side. After the insulative housing, the conductive terminals and the base are assembled with each other, the connecting end of each terminal is received and constrained within a corresponding groove such that no left or right positional deviation will occur and such that adjacent terminals do not contact each other. When the terminals are soldered to wires of the cable, corresponding wires will be respectively connected to the connecting ends and constrained by the respective groove. During soldering, both the wires and the connecting ends are supported by the base, thereby assuring a reliable electrical connection between the cable and the conductive terminals. However, the base interlocks with the insulative housing only by engagement between connecting surfaces at two sides of the stop block and the protruding flanges of the housing. When an over-molding process is applied to manufacture a protective sleeve, a flowable plastic material must be first injected into the mold so as to form the protective sleeve. However, high pressure generated upon injection of the molding material will keep the material to flow continuously. Therefore, the spacer is easily subject to impact so as to be moved with respective to the housing, which inevitably affects an electrical connection between the terminals and the wires of the cable.

Hence, it is desired to provide a cable end connector assembly with an improved spacer to avoid the foregoing drawbacks.

SUMMARY OF THE INVENTION

A main object of the present invention is to provide a cable end connector assembly having a spacer which can ensure a reliable electrical connection between contact units and wires.

In order to achieve the object set forth, a cable end connector assembly in accordance with the present invention comprises an insulative housing, a plurality of contact units, a spacer, a plurality of wires, and a cover. The housing comprises a pair of keys in a rear wall thereof. Each contact unit comprises at least one mating portion adapted for electrically connecting a complementary connector, and a U-shaped tail portion opposite to the mating portion. The spacer comprises a body portion defining a plurality of through holes extending therethrough, opposite side portions each defining a keyway in an outside thereof, and a supporting portion projecting from the body portion and connecting with the side portions. The supporting portion defines a plurality of grooves in a top surface thereof. Each wire comprises a conductive core received in corresponding U-shaped tail portion and soldered with the tail portion to form electrical connection therebetween. The cover is over-molded with a rear end of the housing and covers front ends of the wires to protect the electrical connection between the wires and the contact units.

Other objects, advantages and novel features of the invention will become more apparent from the following detailed description when taken in conjunction with the accompanying drawings.

DETAILED DESCRIPTION OF THE INVENTION

Figure 1:
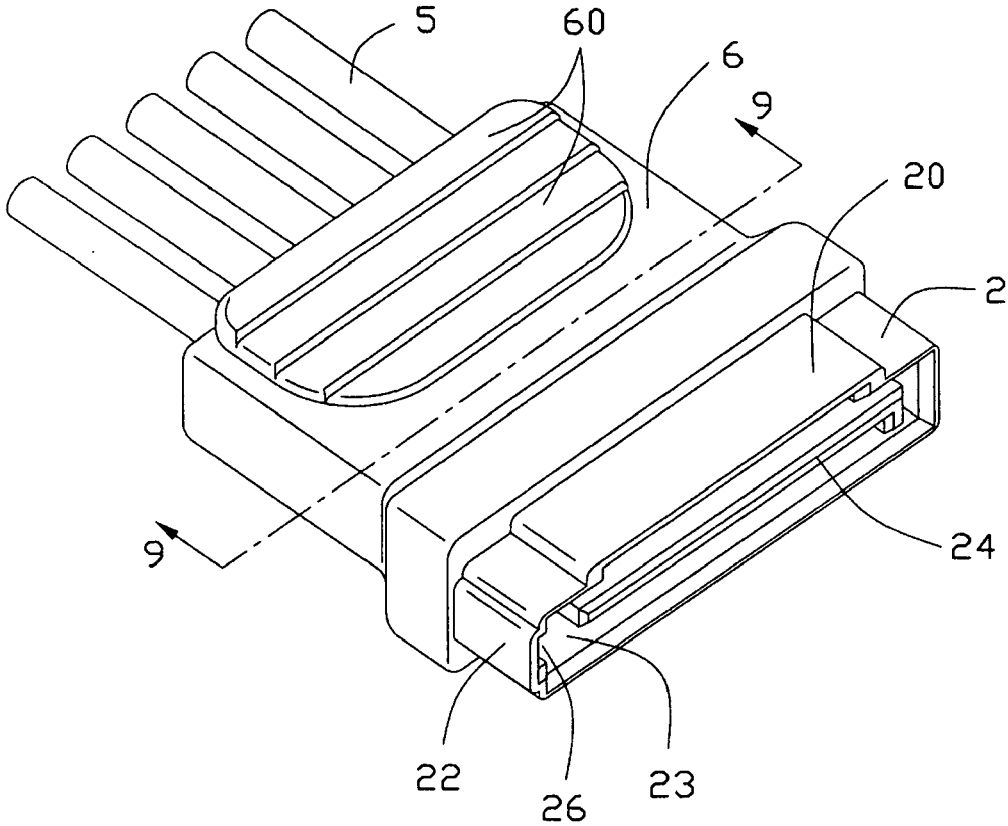
FIG. 1 is a perspective view of a cable end connector assembly in accordance with the present invention.

Reference will now be made in detail to the preferred embodiment of the present invention.

Referring to FIGS. 1 to 4, a cable end connector assembly 1 in accordance with the present invention comprises an insulative housing 2, a plurality of contact units 3 received in the insulative housing 2, a spacer 4 attached to the insulative housing 2, a plurality of wires 5 electrically connected to corresponding contact units 3, and a cover 6. In the preferred embodiment of the present invention, the cable end connector assembly 1 is a Serial ATA cable end connector assembly.

The insulative housing 2 comprises a top wall 20, a bottom wall 21 opposite to the top wall 20, a pair of sidewalls 22 connecting the top and bottom walls 20, 21, and a rear wall 27, which together define a receiving space 23. An L-shaped tongue 24 extends forwardly from the rear wall 27 and into the receiving space 23. A plurality of passageways 25 is defined in a bottom face of the L-shaped tongue 24 and extends through the rear wall 27. A guiding slot 26 is defined in a side wall 22 and communicates with the receiving space 23 for receiving a corresponding guiding projection of a complementary electrical connector (not shown). The housing 2 has a pair of wedge-shaped keys 28 extending from two opposite sides of the rear wall 27 thereof. The housing 2 defines a plurality of apertures 29 in the rear wall 27 thereof.

Each contact unit 3 has a fork-shaped configuration and comprises a base portion 30, three retention portions 31 extending forwardly from the base portion 30, three mating portions 32 extending forwardly from corresponding retention portions 31, and a U-shaped tail portion 33 extending rearwardly from a rear edge of the base portion 30. Each retention portion 31 forms a plurality of barbs 310 on opposite sides thereof. Each U-shaped tail portion 33 of the contact units 3 defines a plurality of holes 330 in a bottom surface thereof for enhancing a soldering force between the U-shaped tail portion 33 and the wire 5.

Figure 5:
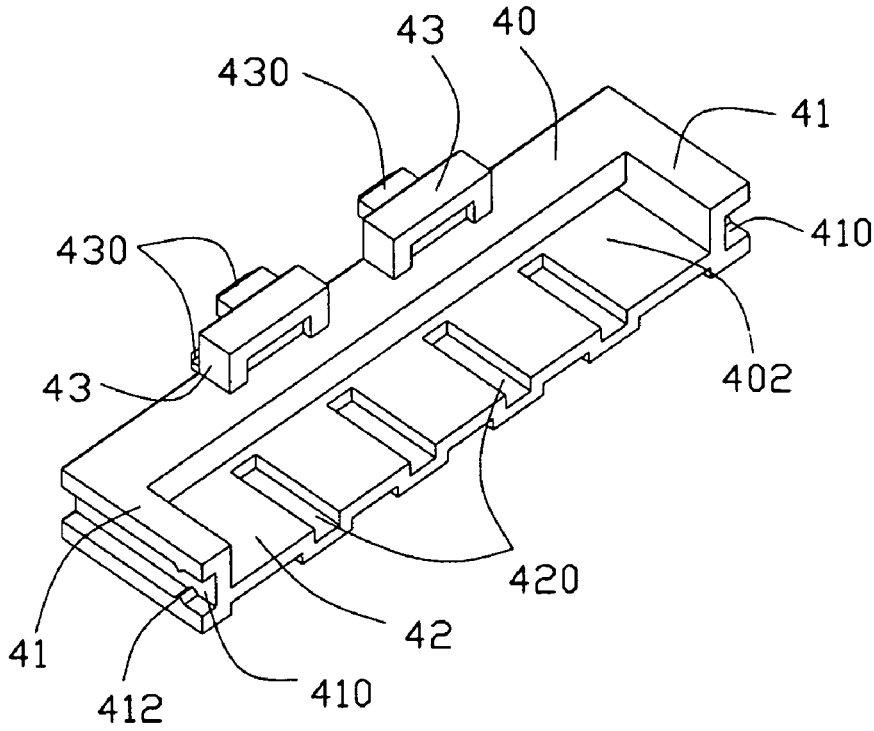
FIG. 5 is a perspective view of a spacer of the cable end connector assembly.
Figure 6:
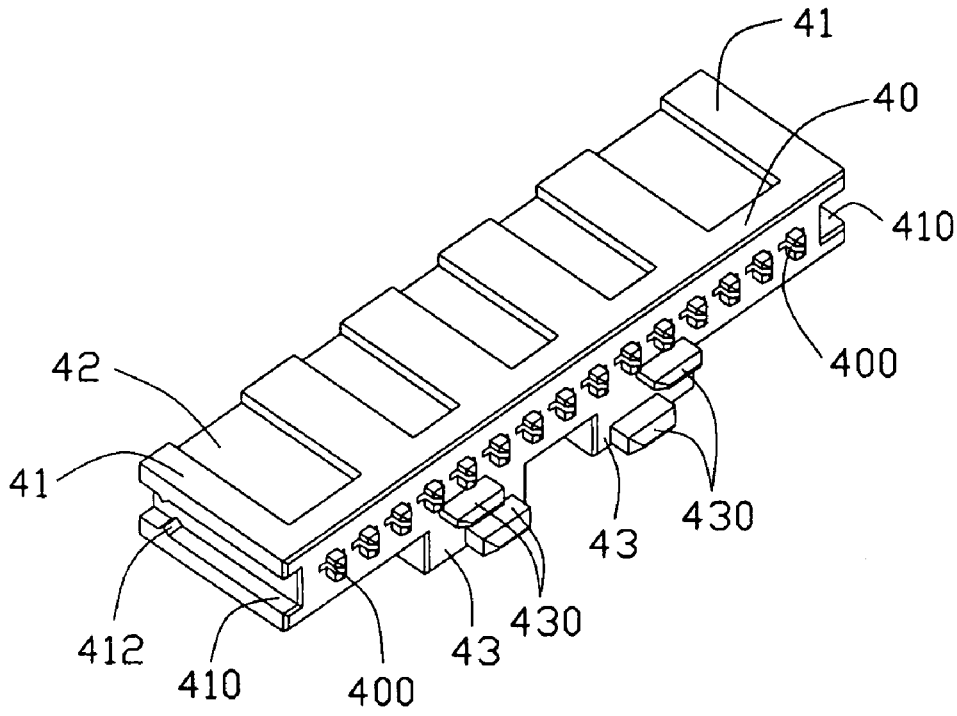
FIG. 6 is a view similar to FIG. 5, but taken from a bottom aspect.

Referring to FIGS. 5 and 6, the spacer 4 comprises a body portion 40, and a pair of side portions 41 extending outwardly and rearwardly from two opposite longitudinal ends of the body portion 40. The body portion 40 defines a plurality of through holes 400 extending therethrough. Each of the side portions 41 defines a keyway 410 in an outside thereof and a pair of protruding ribs 412 extending into the keyway 410 oppositely. A supporting portion 42 projects rearwardly from the body portion 40 below the through holes 400 and connects with the side portions 41. A gap 402 is defined between a top surface of the supporting portion 42 and the body portion 40, and communicates with the through holes 400. A plurality of grooves 420 is defined in the top surface of the supporting portion 42. The spacer 4 has a pair of platforms 43 protruding upwardly from a top wall of the body portion 40. Two pairs of protrusions 430 project forwardly from a front surface of the body portion 40.

Figure 3:
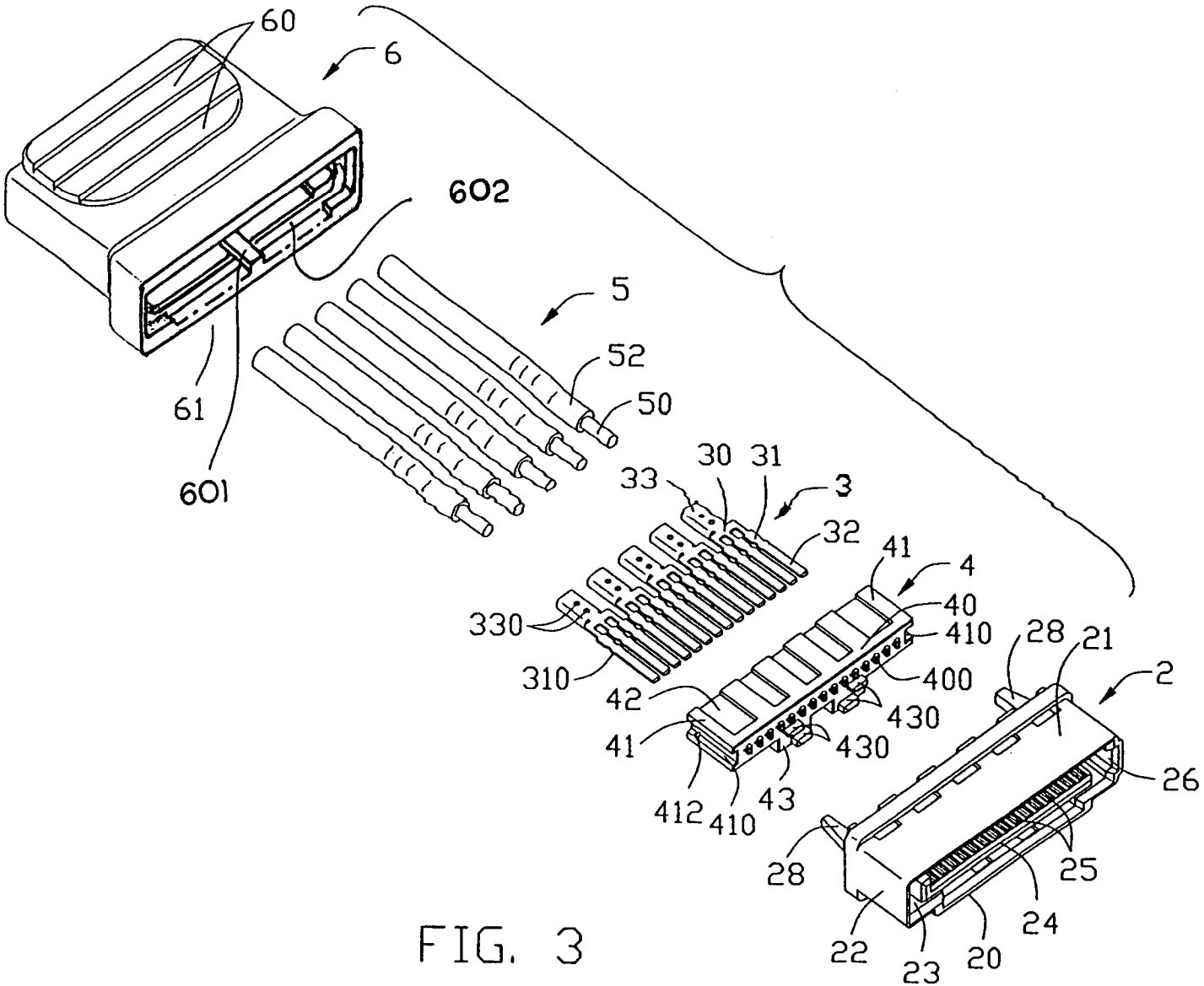
FIG. 3 is an exploded, perspective view of FIG. 2.
Figure 4:
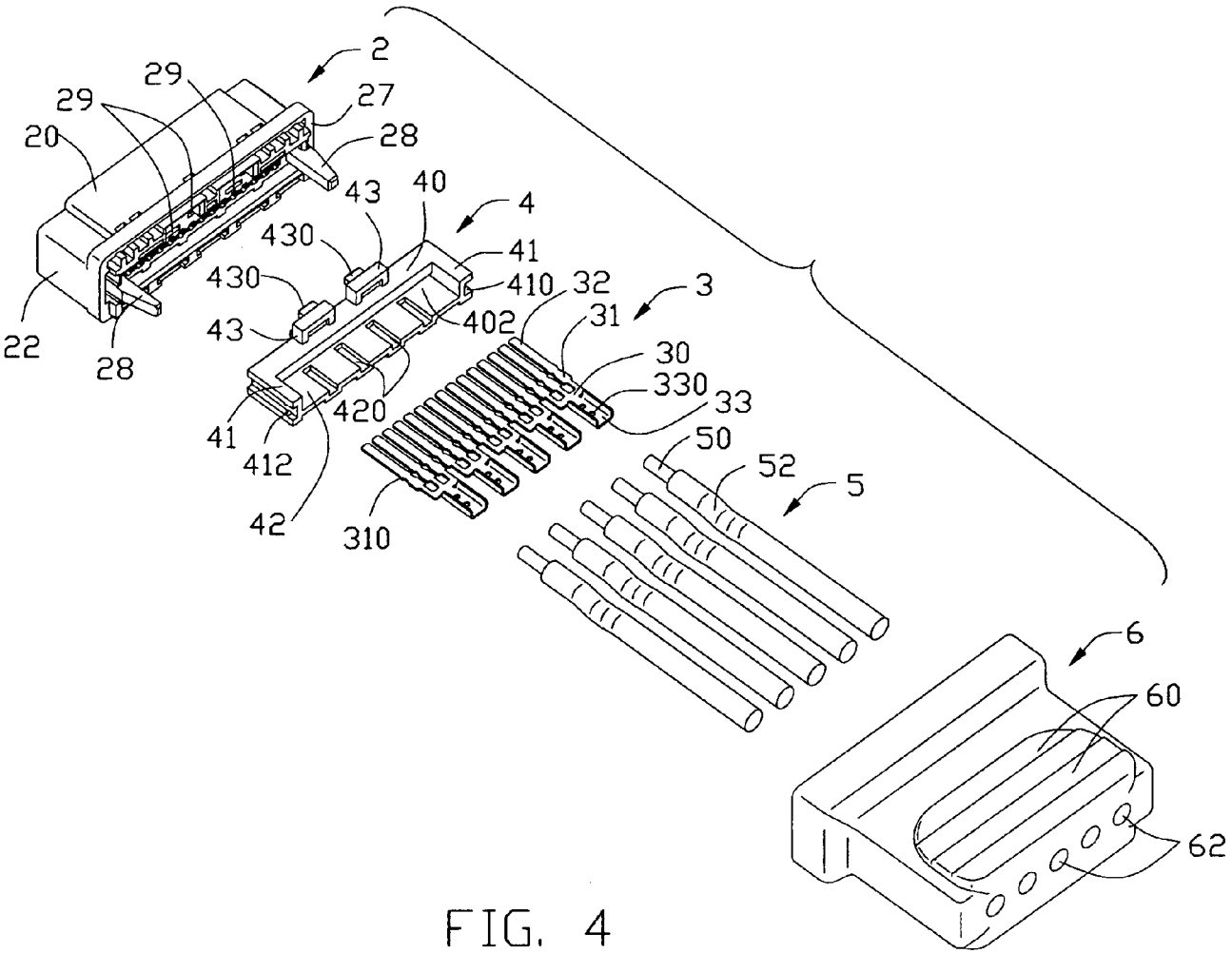
FIG. 4 is a view similar to FIG. 3, but taken from a different aspect.

Referring to FIGS. 3 and 4, each wire 5 comprises a conductive core 50 surrounded by an outer insulating cover 52.

The cover 6 is preferably comprised of molded plastic or polymer material and over-molded with a rear end of the insulative housing 2 and front ends of the wires 5. A plurality of steps 60 are formed on upper and lower surfaces of the cover 6 for being grasped conveniently. A receiving cavity 61 is defined in a front portion of the cover 6 for receiving the rear end of the insulative housing 2. A plurality of receiving holes 62 is defined in a rear portion of the cover 6 corresponding to the wires 5.

Figure 7:
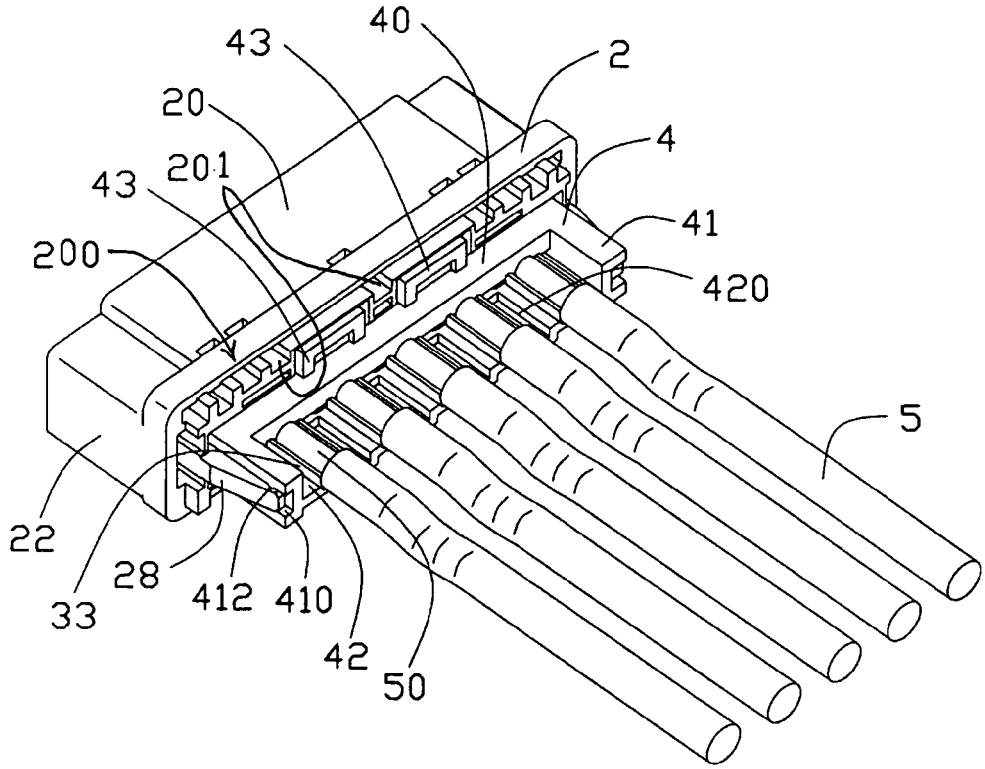
FIG. 7 is an assembled view of the cable end connector assembly with a cover being removed therefrom.
Figure 8:
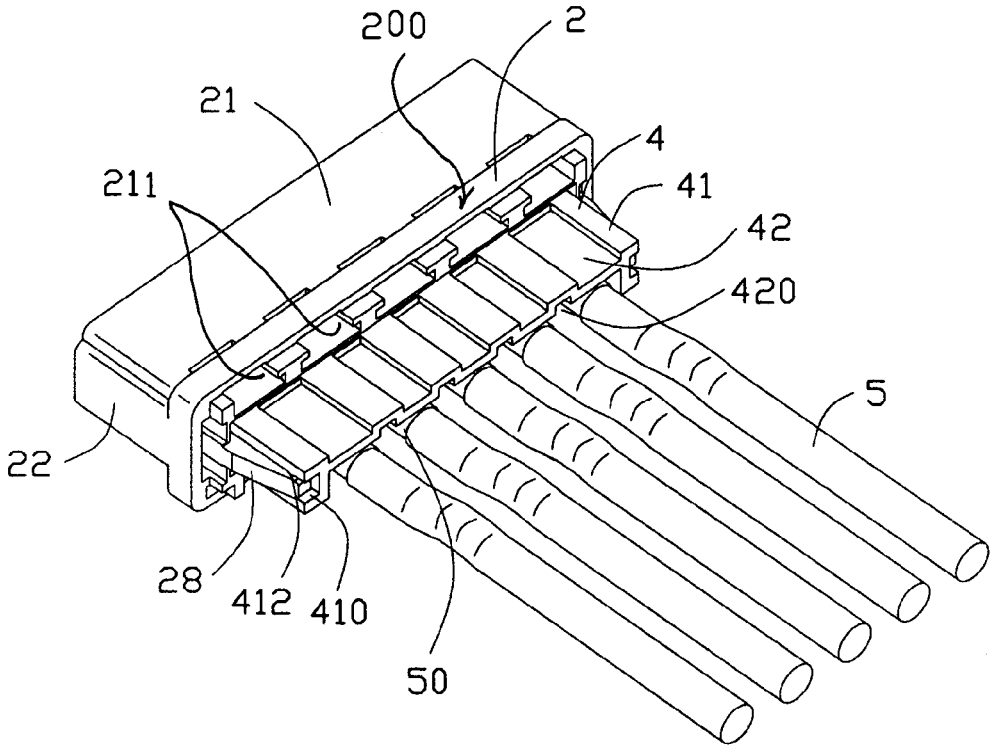
FIG. 8 is a view similar to FIG. 7, but taken from a bottom aspect.
Figure 9:
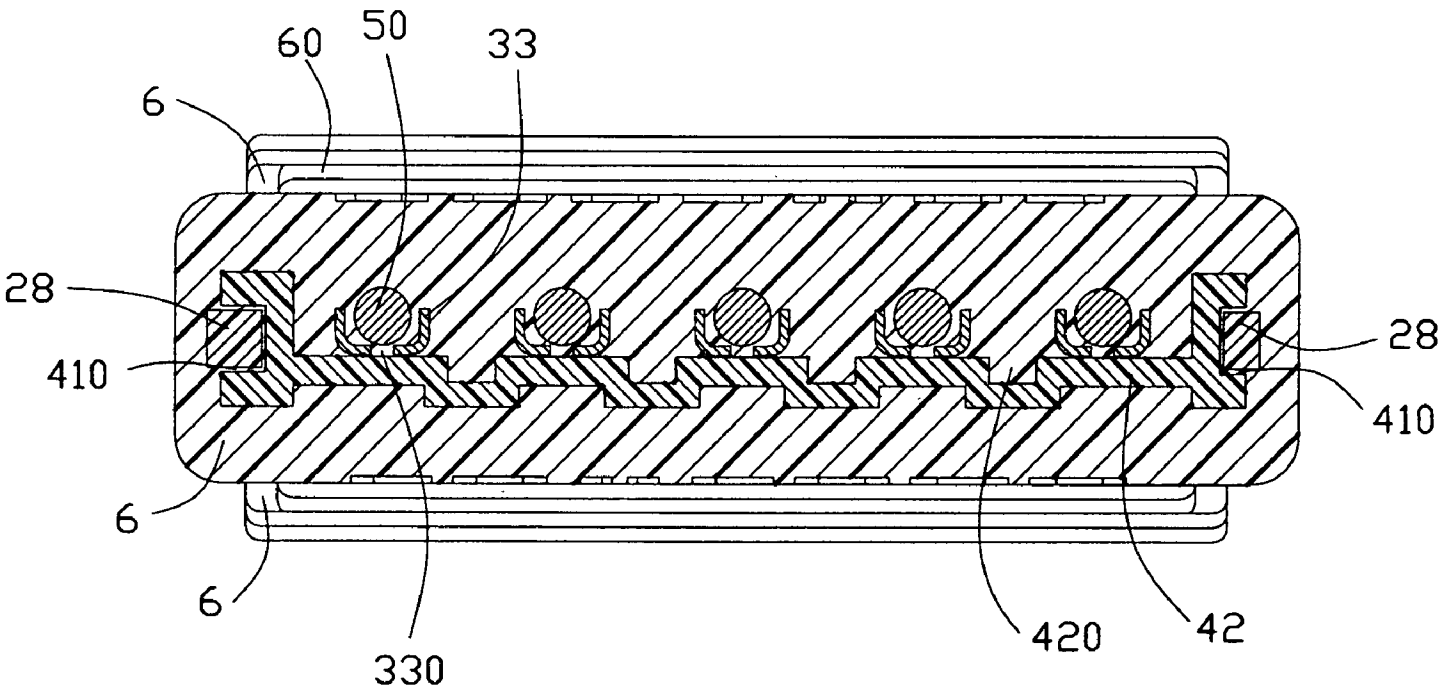
FIG. 9 is a cross-sectional view of FIG. 1 taken along line 9—9.

In assembly, referring to FIGS. 3–4 in conjunction with FIGS. 7–9, the contact units 3 are first inserted into the spacer 4 from the gap 402 in a rear-to-front direction until a front edge of each base portion 30 abuts against the body portion 40. Each mating portion 32 and each retention portion 31 of the contact unit 3 extend through the through hole 400 of the body portion 40, and the U-shaped tail portion 33 of the contact unit 3 is exposed on a rear surface of the body portion 40 and is supported by the supporting portion 42 of the spacer 4 for being soldered with a corresponding front end of the wire 5. Each groove 420 is disposed between adjacent two U-shaped tail portions 33 so that adjacent two contact units 3 do not contact each other.

Then, the spacer 4 with the contact units 3 is pushed and received into the housing 2. The keys 28 of the housing 2 are reliably received in the keyways 410 of the spacer 4 with the protruding ribs 412 tightly abutting against top and bottom walls of the keys 28, and the protrusions 430 of the spacer 4 engage with and are latched in the apertures 29 of the housing 2 so as to secure the spacer 4 to the housing 2 firmly. Each mating portion 32 of the contact unit 3 protrudes through and is received in a corresponding passageway 25 and is partly exposed in the receiving space 23 for electrically connecting the complementary electrical connector. Each retention portion 31 of the contact unit 3 is received in corresponding passageway 25 and the barbs 310 interferentially engage with two opposite inner walls of the passageway 25. The spacer 4 substantially seals the passageways 25 of the housing 2 and efficiently prevents melted plastic material of the cover 6 from entering into the passageways 25 and influencing the electrical connection between the cable end connector assembly 1 and the complementary connector.

Referring to FIGS. 7 to 9, the conductive cores 50 of the wires 5 are received and soldered onto the U-shaped tail portions 33 of the contact units 3 respectively. The conductive core 50 of the wire 5 is constrained within the U-shaped tail potion 33 to prevent the conductive core 50 from left or right positional deviation and the U-shaped tail potion 33 increases the contact area between the tail portion 33 and the conductive core 50, thus assures reliable connection therebetween. Furthermore, during soldering, since the U-shaped tail portions 33 of the contact units 3 and the conductive core 50 of the wire 5 can be simultaneously supported by the supporting portion 42 of the spacer 4, the reliability of the solder connection is greatly improved.

Figure 2:
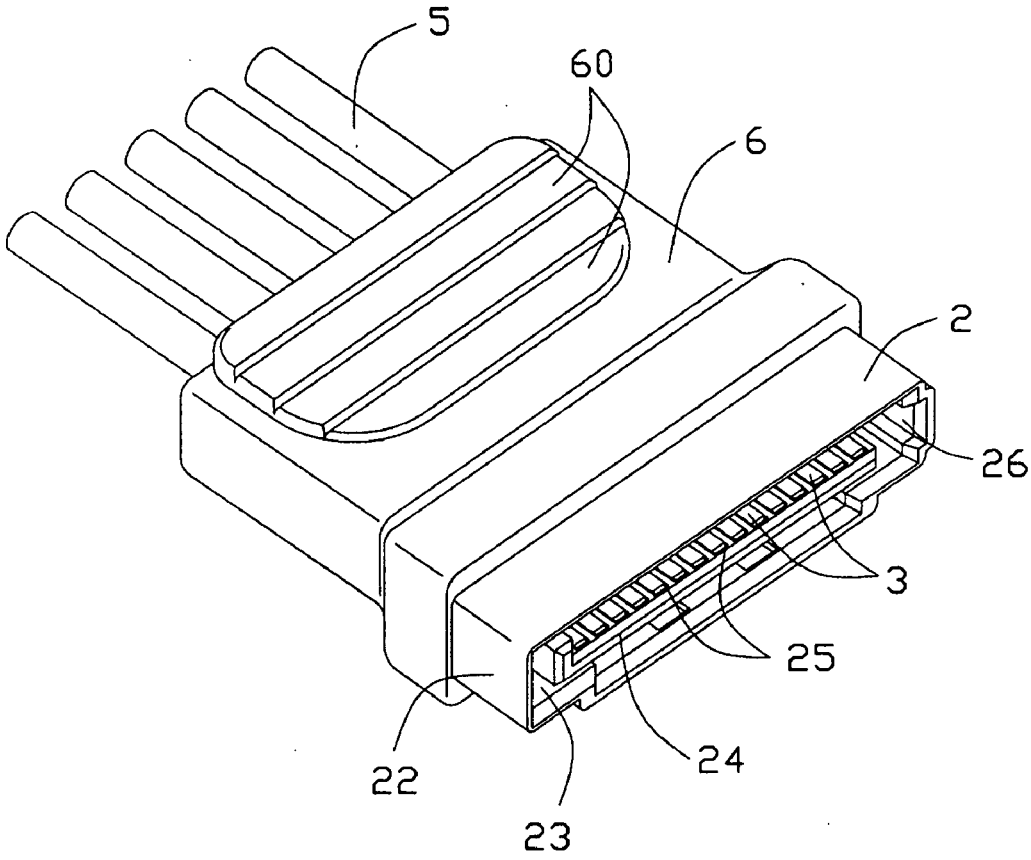
FIG. 2 is a view similar to FIG. 1, but taken from a bottom aspect.

Referring to FIGS. 1 and 2 in conjunction with FIGS. 3 and 4, the cover 6 is finally over-molded with the rear end of the housing 2 and the front ends of the wires 5. The rear end of the housing 2 is received in the receiving cavity 61 and each wire 5 is received in a corresponding receiving hole 62. The cover 6 forms a strain relief between the housing 2 and the wires 5, and also protects the electrical connections between the U-shaped tail portions 33 and the conductive cores 60. The spacer 4 is firmly assembled to the housing 2 by engagement of the keys 28 and the keyways 410, as well as the protrusion 430 and the apertures 29. During overmolding, even if the spacer is subject to the high pressure of the plastic injected material, the spacer 4 will not be displaced thereby assuring the reliable electrical connections between the contact units 3 and the wires 5. Thus, the cable end connector assembly 1 in accordance with the present invention has good electric transmission performances.

It is noted that the housing 2 forms an elongated bar 200 (FIGS. 7 and 8) which is received in the circumferential groove 602 of the cover 6 (FIG. 3) after over-molding of the cover 6. Moreover, the recesses 201, 211 are formed in the housing 2 and extend along the front-to-back direction (FIGS. 7 and 8) and purposely pass under the bar 200 so that when the cover 6 is overmolded on the housing 2, the cover 6 defines five transverse short beams 601 (only one shown in FIG. 3) occupying the corresponding five recesses 201, respectively. This assures the cover 6 fully/circumferentially surrounds and grasps the bar 200 in a cross-sectional view taken along a vertical plane in the front-to-back direction. Understandably, there is another set of transverse bars (not shown) occupying the corresponding recesses 211 for the same purpose. It is understandable that the recess 201 and 211 should be exposed by or extend beyond two sides of the bar 200 so as to be able to allow the corresponding transverse short beam 601 to cooperate with other portions of the cover 6 to fully circumferentially grasp the bar 200 in the aforementioned cross-sectional view after molding. This grasp provides better retention/engagement between the cover 6 and the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a top wall, a bottom wall, opposite sidewalls and a rear wall, which together define a receiving space for receiving a complementary electrical connector, an L-shaped tongue projecting forwardly from said rear wall and extending into said receiving space, a plurality of passageways defined in the L-shaped tongue and extending through said rear wall, the housing including a pair of keys extending rearwardly from two opposite sides thereof;

a plurality of contact units received in corresponding passageways, each contact unit having at least one mating portion and a tail portion opposite to the at least one mating portion; and a spacer attached to the insulative housing and comprising a body portion and a supporting portion projecting from the body portion, the body portion defining a plurality of through holes communicating with the passageways for insertion of the contact units therethrough and a pair of keyways on opposite sides thereof.

2. The electrical connector as claimed in claim 1, wherein said spacer defines a gap between said supporting portion and the body portion.

3. The electrical connector as claimed in claim 2, wherein said supporting portion defines a plurality of grooves in a top surface thereof.

4. The electrical connector as claimed in claim 1, wherein said keyway has a protruding rib in an inner wall thereof.

5. The electrical connector as claimed in claim 1, wherein said spacer has a pair of platforms protruding upwardly from a top side of the body portion along a front surface thereof.

6. The electrical connector as claimed in claim 1, wherein said spacer further comprises a plurality of protrusions projecting respectively from a front surface of the body portion, and wherein the insulative housing defines a plurality of apertures for latching with the protrusions.

7. The electrical connector as claimed in claim 1, wherein said insulative housing has a guiding slot defined in one sidewall thereof and communicating with said receiving space.

8. The electrical connector as claimed in claim 1, wherein said tail portion of the contact unit has a U-shaped configuration and extends along a top face of the supporting portion.

9. The electrical connector as claimed in claim 8, wherein said contact unit has a fork-shaped configuration and further comprises a base portion and three retention portions extending forwardly from the base portion, three mating portions extending forwardly from corresponding retention portions and the U-shaped tail portion extending rearwardly from a rear edge of the base portion.

10. The electrical connector as claimed in claim 9, wherein each retention portion forms a plurality of barbs on two opposite sides thereof.

11. A cable connector assembly comprising:

an insulative housing defining a mating port in a front-to-back direction;

a plurality of contacts disposed in the housing;

a cable connected to a rear end of the housing and including a plurality of conductors electrically connected to the corresponding contacts, respectively;

a bar formed on a face of said housing along a direction perpendicular to said front-to-back direction; and a cover overmolded on said housing and said cable; wherein said cover veils said bar and includes at least one transverse beam extending along said front-to-back direction and engaged with the bar in at least one direction perpendicular to said front-to-back direction, and wherein said transverse beam cooperates with other portions of the bar to circumferentially grasp the bar in a cross-sectional view taken along a vertical plane in said front-to-back direction.

12. The assembly as claimed in claim 11, wherein at least one recess is formed in said face, and said recess extends along said front-to-back direction and passes under said bar and beyond both two sides of the bar, and wherein said transverse beam occupies said recess.

13. The assembly as claimed in claim 12, wherein said recess does not extend through a front face of the housing.

14. The assembly as claimed in claim 11, wherein said direction is a longitudinal direction of the housing and said bar is an elongated bar.

* * * * *